United States Patent [19]

Abe

[11] 4,283,619

[45] Aug. 11, 1981

[54] GLOW PLUG TEMPERATURE CONTROL APPARATUS

[75] Inventor: Yoshiaki Abe, Higashimatsuyama, Japan

[73] Assignee: Diesel Kiki Company, Ltd., Tokyo, Japan

[21] Appl. No.: 22,722

[22] Filed: Mar. 21, 1979

[30] Foreign Application Priority Data

Apr. 4, 1978 [JP] Japan ..... 53-44140[U]

[51] Int. Cl.[3] ..... H05B 1/02

[52] U.S. Cl. ..... 219/492; 219/497; 219/501; 123/179 H; 361/264

[58] Field of Search ..... 219/494, 492, 501, 497, 219/216; 361/264; 123/179 H, 179 B, 179 BG, 145 A, 145 R

[56] References Cited

U.S. PATENT DOCUMENTS

| | | | |
|---|---|---|---|
| 2,840,067 | 6/1958 | Carlson | 123/145 A |
| 3,509,322 | 4/1970 | Lundin | 219/501 |
| 3,813,516 | 5/1974 | Kudsi et al. | 219/216 |
| 3,819,904 | 6/1974 | Novak | 219/492 |
| 3,894,282 | 7/1975 | MacFarland, Jr. | 219/492 |
| 4,130,853 | 12/1978 | Baker | 219/497 |
| 4,137,885 | 2/1979 | Van Ostrom | 123/179 BG |

*Primary Examiner*—Gene Z. Rubinson
*Assistant Examiner*—M. Paschall
*Attorney, Agent, or Firm*—David G. Alexander

[57] ABSTRACT

Glow plugs (16), (17), (18), (19) for a Diesel engine are connected to a power source (12) through a switch (13) to receive electrical power. A time constant circuit including a capacitor (32) and resistors (31), (33) is connected to the power source (12) through another switch (27) together with the glow plugs (16), (17), (18), (19). The time constant circuit is constructed so that the voltage across the capacitor (32 ) is proportional to the temperature of the glow plugs (16), (17), (18), (19). A comparator (34) opens the switches (13), (27) to disconnect the power source (12) from the glow plugs (16), (17), (18), (19) and time constant circuit when the voltage across the capacitor (32) is above a predetermined value and closes the switches (13), (22) to connect the power source (12) to the glow plugs (16), (17), (18), (19) and time constant circuit when the voltage across the capacitor (32) is below the predetermined value. This has the effect of heating the glow plugs (16), (17), (18), (19) to a predetermined temperature and maintaining them at the predetermined temperature.

10 Claims, 2 Drawing Figures

GLOW PLUG TEMPERATURE CONTROL APPARATUS

BACKGROUND OF THE INVENTION

The present invention relates to a glow plug temperature control apparatus for a Diesel engine in which a glow plug is employed to preheat a combustion chamber to facilitate starting the engine.

In the prior art a glow plug is energized with electrical power and thereby raised to a high temperature for a predetermined period of time. Then, an attempt is made to start the engine. If the engine does not start the first time, the glow plug is energized again for the same period of time and another attempt made to start the engine. This procedure is repeated until the engine starts.

Improved glow plugs have been developed which heat up very quickly when electrically energized and tend to overheat and fuse the heating elements thereof if energized for too long. Energizing such a glow plug for a correct length of time from a cold condition will heat it to the desired temperature. However, after the glow plug is de-energized the temperature thereof does not fall instantaneously. Instead, it falls exponentially at a rate which may be determined experimentally.

For this reason, if the glow plug is initially heated and an unsuccessful attempt is made to start the engine, the glow plug will again be energized for the predetermined length of time and another attempt made to start the engine. However, the second heating of the glow plug will begin before the glow plug has had time to cool to ambient temperature, and the temperature of the glow plug will still be quite high. Since the second heating of the glow plug begins while the glow plug is still at an elevated temperature, it will result in the glow plug being heated to an excessive temperature. Several unsuccessful attempts to start the engine and corresponding heating operations of the glow plug will cause the temperature of the glow plug to rise so high that the heating elements thereof will fuse and result in destruction of the glow plug.

SUMMARY OF THE INVENTION

It has been determined that the temperature of a glow plug of the improved type rises exponentially upon application of electrical power in a manner that may be approximated quite closely by a time constant circuit comprising a resistor and capacitor in series. If the values of the resistor and capacitor and thereby the time constant of circuit are chosen correctly, the voltage across the capacitor will be proportional to the temperature of the glow plug. In a similar manner, the temperature drop of the glow plug upon de-energization may be approximated closely by the same capacitor discharged through another resistor. It is here assumed that the heating and cooling time constants of the glow plug are different. This principle is used to advantage in accordance with the present invention to heat a glow plug to an optimum temperature and automatically maintain it at this temperature.

A glow plug temperature control apparatus embodying the present invention includes a glow plug, power source means for applying electric power to the glow plug and first switch means connected between the power source means and the glow plug. Time constant circuit means include capacitance means and resistance means. Second switch means are connected between the power source means and the time constant circuit means. Control means are constructed to sense a voltage across the capacitance means and control the first and second switch means to connect the power source means to the glow plug and time constant circuit means in accordance therewith, the time constant circuit means being constructed so that the voltage across the capacitance means is proportional to a temperature of the glow plug.

In accordance with the present invention, a glow plug for a Diesel engine is connected to a power source through a switch to receive electrical power. A time constant circuit including a capacitor and resistors is connected to the power source through another switch together with the glow plug. The time constant circuit is constructed so that the voltage across the capacitor is proportional to the temperature of the glow plug. A comparator opens the switches to disconnect the power source from the glow plug and time constant circuit when the voltage across the capacitor is above a predetermined value and closes the switches to connect the power source to the glow plug and time constant circuit when the voltage across the capacitor is below the predetermined value. This has the effect of heating the glow plug to a predetermined temperature and maintaining it at the predetermined temperature.

It is an object of the present invention to provide a glow plug temperature control apparatus which quickly heats a glow plug to a desired temperature and automatically maintains it at this temperature.

It is another object of the present invention to provide a glow plug temperature control apparatus which positively prevents overheating of a glow plug, even a glow plug of an improved fast heating type.

It is another object of the present invention to provide a glow plug temperature control apparatus for a Diesel engine which is highly reliable in operation but which may be manufactured at low cost on a commercial production basis.

It is another object of the present invention to provide a generally improved glow plug temperature control apparatus for a Diesel engine.

Other objects, together with the foregoing, are attained in the embodiment described in the following description and illustrated in the accompanying drawing.

DESCRIPTION OF THE PREFERRED EMBODIMENT

While the glow plug temperature control apparatus of the present invention is susceptible of numerous physical embodiments, depending upon the environment and requirements of use, substantial numbers of the herein shown and described embodiment have been made, tested and used, and all have performed in an eminently satisfactory manner.

Figure 1:
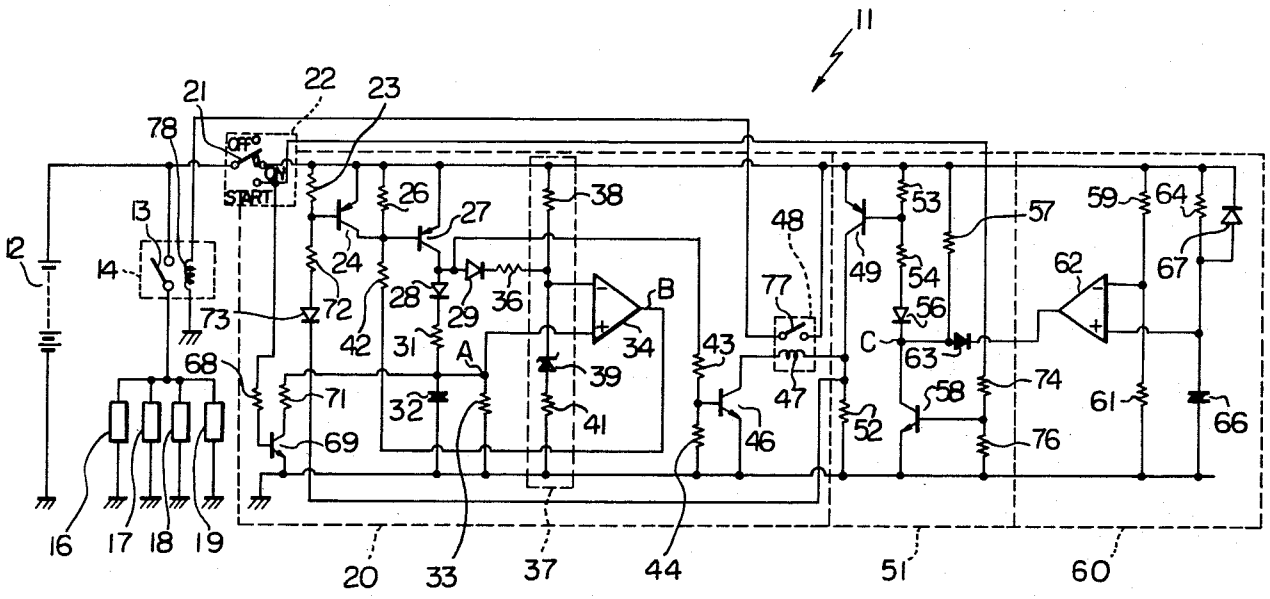
FIG. 1 is an electrical schematic diagram illustrating a glow plug temperature control apparatus embodying the present invention.

Referring now to FIG. 1 of the drawing, a glow plug temperature control apparatus embodying the present invention is generally designated by the reference numeral 11 and comprises a power source such as a battery 12 having a grounded negative terminal. The positive terminal of the battery 12 is connected through normally open relay contacts 13 of a relay 14 and four glow plugs 16, 17, 18 and 19 to ground. The contacts 13 serve as a first switch means for connecting or disconnecting the glow plugs 16 to 19 and the battery 12. The glow plugs 16 to 19 are located in respective combustion chambers of a Diesel engine (not illustrated) and are heated when electrically energized to preheat the combustion chambers.

The positive terminal of the battery 12 is also connected to a movable contact 21 of a power control switch 22 which is actuated by the engine operator. The switch 22 has three fixed contacts which correspond to respective switch positions. In an off position the movable contact 21 is connected to a fixed contact OFF which is not connected to any other part of the apparatus 11. In an on position the movable contact 21 is connected to a fixed contact ON. In a start position the movable contact 21 is connected to both the ON contact and a fixed START contact.

The ON contact of the switch 22 is connected directly to the emitter of a PNP transistor 24 of a control unit 20 and through a resistor 23 to the base of the transistor 24. The collector of the transistor 24 is connected to the ON contact of the switch 22 through a resistor 26 and also to the base of a PNP transistor 27. The emitter of the transistor 27 is connected to the ON contact. The collector of the transistor 27 is connected to the anodes of reverse blocking diodes 28 and 29. The cathode of the diode 28 is connected through a charging resistor 31 and a capacitor 32 to ground. The junction of the capacitor 32 and resistor 31 is connected through a discharging resistor 33 to ground and also to the non-inverting input of a voltage comparator 34.

The cathode of the diode 29 is connected through a resistor 36 to the inverting input of the comparator 34. A constant voltage source 37 comprises a resistor 38, a zener diode 30 and a resistor 41 which are connected in series between the ON contact and ground. The cathode of the zener diode 39 is connected to the inverting input of the comparator 34.

The output of the comparator 34 is connected through a resistor 42 to the base of the transistor 27. The capacitor 32 in combination with the resistors 31 and 33 constitutes a time constant circuit (not designated).

The collector of the transistor 27 is also connected to ground through resistors 43 and 44 which are connected in series with each other. The junction of the resistors 43 and 44 is connected to the base of an NPN transistor 46, the emitter of which is grounded. The collector of the transistor 46 is connected through a relay coil 47 of a relay 48 to the collector of a PNP transistor 49 of a timer disable unit 51. The collector of the transistor 49 is grounded through a resistor 52. The emitter of the transistor 49 is connected to the ON contact.

The base of the transistor 49 is connected to the ON contact through a resistor 53 and also through a resistor 54 to the anode of a reverse blocking diode 56. The cathode of the diode 56 is connected to the ON contact through a resistor 57 and also to the collector of an NPN transistor 58. The emitter of the transistor 58 is grounded.

Resistors 59 and 61 of a timer unit 60 are connected in series with each other between the ON contact and ground. The junction of the resistors 59 and 61 is connected to the inverting input of a voltage comparator 62. The output of the comparator 62 is connected to the cathode of a diode 63, the anode of which is connected to the cathode of the diode 56.

A resistor 64 and capacitor 66 are connected in series between the ON contact and ground. The junction of the resistor 64 and capacitor 66 is connected to the non-inverting input of the comparator 62 and also to the anode of a reverse blocking diode 67. The cathode of the diode 67 is connected to the ON contact of the switch 22.

The START contact of the switch 22 is connected through a resistor 68 to the base of an NPN transistor 69. The emitter of the transistor 69 is grounded and the collector thereof is connected through a resistor 71 to the non-inverting input of the comparator 34.

The base of the transistor 24 is connected through a resistor 72 to the anode of a diode 73. The cathode of the diode 73 is connected to the collector of the transistor 49.

The START contact is also connected through resistors 74 and 76 to ground. The junction of the resistors 74 and 76 is connected to the base of the transistor 58. The ON contact of the switch 22 is connected through normally open relay contacts 77 of the relay 48 and a relay coil 78 of the relay 14 to ground.

To start the engine the power switch 22 is changed over from the off position to the on position in which the movable contact 21 engages only with the ON contact. The resistors 59 and 61 function as a voltage divider to apply a predetermined reference voltage to the inverting input of the comparator 62. The capacitor 66 begins to charge through the resistor 64. However, the time constant of the resistor 64 in combination with the capacitor 66 is selected to be relatively long so that the voltage across the capacitor 66 takes a relatively long period of time to reach the level of the reference voltage. Since the voltage across the capacitor 66 is initially below the reference voltage, the comparator 62 produces a low output which is gated through the diodes 63 and 56 and resistor 54 to the transistor 49. The voltage at the junctions of the diodes 63 and 56 is designated as C. The low base voltage of the transistor 49 causes the transistor 49 to be turned on and connect the base of the transistor 24 to the ON contact of the switch 22 through the diode 73 and resistor 72. This causes the transistor 24 to be turned off and be effectively disconnected from the remainder of the circuit.

Since the capacitor 32 is initially discharged, the voltage thereacross is zero. The zener diode 39 and resistors 38 and 41 apply a predetermined reference voltage to the inverting input of the comparator 34, with the zener diode 39 making the reference voltage independent of fluctuations in the voltage of the battery 12. Since the voltage across the capacitor 32, which is designated as A, is initially lower than the reference voltage at the inverting input of the comparator 34, the comparator 34 produces a low output which is fed back to the transistor 27 to turn the same on. The capacitor 32 begins to charge through the transistor 27, diode 28 and resistor 31 and the voltage A begins to rise.

The time constant determined by the values of the resistor 31 and capacitor 32 is selected to be the same as that of the temperature increase of the glow plugs 16 to 19. The glow plugs 16 to 19 are connected to the battery 12 at the same time as the capacitor 32 as follows.

The transistor 27, which functions as a second switch means, is turned on connecting the resistors 43 and 44 across the battery 12 and ground through the switch 22.

The base voltage of the transistor 46 goes high, thereby turning the transistor 46 on. The transistor 46 connects the relay coil 47 across the battery 12 and results in closing of the contacts 77. The relay coil 78 is connected across the battery 12 through the relay contacts 77. The energized relay coil 78 closes the contacts 13 and connects the glow plugs 16 to 19 across the battery 12. It will thus be seen that the transistor 27 functions to supply power to the capacitor 32 and glow plugs 16 to 19 together.

The capacitor 32 charges until the voltage A exceeds the reference voltage at the inverting input of the comparator 34. At this time the output of the comparator 34, or the signal B, goes high. The high signal B is fed back to the base of the transistor 27 causing the transistor 27 to be turned off. This blocks the supply of current to the capacitor 32 and glow plugs 16 to 19 since the transistor 46 is turned off and the relay coils 47 and 78 are de-energized. Thus, the supply of power to the capacitor 32 and glow plugs 16 to 19 is removed simultaneously.

The capacitor 32 discharges through the resistor 33 which is chosen to provide a time constant equal to that of the temperature decrease of the glow plugs 16 to 19 with the power removed. The capacitor 32 discharges until the voltage A drops below the reference voltage for the comparator 34. At this time the output B of the comparator 34 goes low to turn on the transistor 27 and supply power to the capacitor 32 and glow plugs 16 to 19. This cycle continuously repeats itself. It will thus be understood that the comparator 34 in combination with the time constant circuit and associated components constitutes an astable multivibrator.

Figure 2:
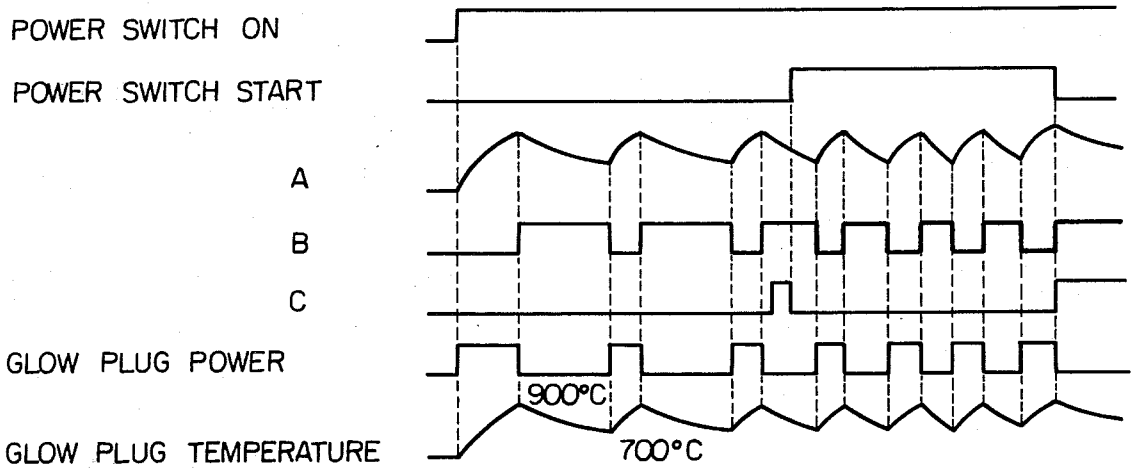
FIG. 2 is a timing diagram illustrating the operation of the present apparatus.

This operation will be better understood with reference also being made to FIG. 2. It will be seen that the magnitude of the voltage A is proportional to the temperature of the glow plugs 16 to 19. Preferably, the comparator 34 is provided with hysterisis in such a manner that the signal B goes high when the signal A exceeds an upper trip point and goes low when the signal A drops below a lower trip point. Such an arrangement provides the curves shown in FIG. 2 in which the power to the glow plugs 16 to 19 is removed when the temperature reaches 900° C. and is restored when the temperature drops down to 700° C. In this manner the glow plug temperature is maintained substantially constant at an average value of 800° C.

The upper two curves in FIG. 2 illustrate connection of the ON and START contacts of the switch 22 with the battery 12 through the movable contact 21. It will be noted that both the ON and START contacts are connected to the battery 12 when the movable contact 21 is moved to the START position.

The timer unit 60 functions to disable the glow plugs 16 to 19 after a predetermined length of time has elapsed after moving the switch 22 from off to on. The main purpose of this feature is to prevent the glow plugs 16 to 19 from being energized after the engine has been started and is running normally.

The time constant of the resistor 64 and capacitor 66 is selected so that the voltage across the capacitor 66 will equal the reference voltage at the inverting input of the comparator 62 at the end of the predetermined time period. In this case the output of the comparator 62 and thereby the signal C go high. This turns off the transistor 49 so that the base of the transistor 24 is connected to ground through the resistor 72, diode 73 and resistor 52. The base voltage of the transistor 24 goes low so that the transistor 24 is turned on and connects the base of the transistor 27 to the ON contact of the switch 22 and thereby to the positive terminal of the battery 12. This turns the transistor 27 off and thereby de-energizes the capacitor 32 and glow plugs 16 to 19. The capacitor 32 and glow plugs 16 to 19 will remain de-energized even if the output B of the comparator 34 is low since the transistor 24 connects the base of the transistor 27 to the ON contact through a very low resistance path. This has the effect of maintaining the control unit 20 and glow plugs 16 to 19 de-energized.

The timer disable unit 51 functions to override the timer unit 60 and prevent it from affecting the control unit 20 and glow plugs 16 to 19 when the switch 22 is moved to the start position. In this case the switch 22 connects the resistors 74 and 76 across the battery 12 and thereby applies a high voltage to the base of the transistor 58. The transistor 58 is turned on and connects the base of the transistor 49 to ground through the low resistance collector circuit of the transistor 58, the resistor 54 and the diode 56. The transistor 49 is turned on and causes the transistor 24 to be turned off. This action causes the timer unit 60 to be disconnected from the control unit 20 regardless of the output of the comparator 62. If the output of the comparator 62 is high, the diode 63 will be reverse biased since the collector voltage of the transistor 58 which appears at the anode of the diode 63 is low. Thus, the transistors 49 and 24 will be turned off and the timer unit 60 disconnected from the control unit 20 regardless of the status of the timer unit 60.

The remaining feature of the present invention to be described regards the transistor 69 and resistor 71. As the engine is being started, the air flow and fuel spray in the combustion chambers tend to lower the temperature of the glow plugs 16 to 19 at a higher rate than if the engine is not being cranked for starting. The resistor 71 functions as a compensation resistor to compensate for this effect. More specifically, when the switch 22 is moved to the start position the battery 12 is connected to the base of the transistor 69 through the switch 22 and resistor 68. This causes the transistor 69 to be turned on and connect the resistor 71 in parallel with the resistor 33 and capacitor 32. This lowers the total resistance in parallel with the capacitor 32 and thereby lowers the discharge time constant of the capacitor 32. In other words, the capacitor 32 discharges through a lower resistance and thereby discharges faster. The resistance value of the resistor 71 is selected so that the time constant of the circuit with the resistor 71 connected in parallel with the resistor 33 is equal to that of the temperature drop of the glow plugs 16 to 19 when the engine is being started and the glow plugs 16 to 19 are de-energized. This action is clearly illustrated in FIG. 2.

In summary, it will be seen that the present invention overcomes the problems of the prior art by providing a glow plug temperature control apparatus which maintains even improved, fast heating glow plugs at a predetermined optimum temperature and positively prevents overheating of the glow plugs. Various modifications will become possible for those skilled in the art after receiving the teachings of the present disclosure without departing from the scope thereof. For example, a single switch may be provided to connect the battery to and disconnect the battery from the glow plugs and time constant circuit, although not illustrated, rather than two switch means.

What is claimed is:

1. A glow plug temperature control apparatus including a glow plug, power source means for applying electric power to the glow plug and first switch means connected between the power source means and the glow plug, characterized by comprising:

time constant circuit means having capacitance means and resistance means;

second switch means connected between the power source means and the time constant circuit means;

control means constructed to sense a voltage across the capacitance means and control the first and second switch means to connect the power source means to the glow plug and time constant circuit means in accordance therewith, the time constant circuit means being constructed so that the voltage across the capacitance means is proportional to a temperature of the glow plug;

the control means being constructed to control the first and second switch means to connect the power source means to the glow plug and time constant circuit means when the voltage across the capacitance means is below a predetermined value and to disconnect the power source means from the glow plug and time constant circuit means when the voltage across the capacitance means is above the predetermined value;

a control switch having an OFF position, an ON position and a START position, the control means comprising timer means for controlling the first and second switch means to maintain the power source means disconnected from the glow plug and time constant circuit means after the control switch has been changed from the OFF position to the ON position for a predetermined length of time;

timer disable means for disconnecting the timer means from the first and second switch means when the control switch is in the START position;

the capacitance means comprising a capacitor, the resistance means comprising a charging resistor connected so that the capacitor charges from the power source means through the second switch means and the charging resistor when the time constant circuit means is connected to the power source means by the second switch means and a discharging resistor connected so that the capacitor discharges through the discharging resistor when the time constant circuit means is disconnected from the power source means by the second switch means; and compensation means for compensating the time constant circuit means when the control switch is in the START position.

2. An apparatus as in claim 1, in which the control means comprises comparator means for comparing the voltage across the capacitance means with the predetermined value.

3. An apparatus as in claim 2, in which the comparator means is constructed to control the first and second switch means to connect the power source means to the glow plug and time constant circuit means when the voltage across the capacitance means is below the predetermined value and to disconnect the power source means from the glow plug and time constant circuit means when the voltage across the capacitance means is above the predetermined value.

4. An apparatus as in claim 3, in which the comparator means is provided with hysterisis.

5. An apparatus as in claim 1, in which the compensation means comprises a compensation resistor and a compensation switch connected in series across the discharging resistor, the compensation switch connecting the compensation resistor to the charging resistor only when the control switch is in the START position.

6. A glow plug temperature control apparatus including a glow plug, power source means for applying electric power to the glow plug and first switch means connected between the power source means and the glow plug, characterized by comprising:

time constant circuit means having capacitance means and resistance means;

second switch means connected between the power source means and the time constant circuit means;

control means constructed to sense a voltage across the capacitance means and control the first and second switch means to connect the power source means to the glow plug and time constant circuit means in accordance therewith, the time constant circuit means being constructed so that the voltage across the capacitance means is proportional to a temperature of the glow plug;

the control means being constructed to control the first and second switch means to connect the power source means to the glow plug and time constant circuit means when the voltage across the capacitance means is below a predetermined value and to disconnect the power source means from the glow plug and time constant circuit means when the voltage across the capacitance means is above the predetermined value;

the capacitance means comprising a capacitor, the resistance means comprising a charging resistor connected so that the capacitor charges from the power source means through the second switch means and the charging resistor when the time constant circuit means is connected to the power source means by the second switch means and a discharging resistor connected so that the capacitor discharges through the discharging resistor when the time constant circuit means is disconnected from the power source means by the second switch means; and a control switch having an ON position and a START position and compensation means for compensating the time constant circuit means when the control switch is in the START position.

7. An apparatus as in claim 6, in which the compensation means comprises a compensation resistor and a compensation switch connected in series across the discharging resistor, the compensation switch connecting the compensation resistor to the charging resistor only when the control switch is in the START position.

8. An apparatus as in claim 6, in which the control means comprises comparator means for comparing the voltage across the capacitance means with a predetermined value.

9. An apparatus as in claim 6, in which the comparator means is constructed to control the first and second switch means to connect the power source means to the glow plug and time constant circuit means when the voltage across the capacitance means is below the predetermined value and to disconnect the power source means from the glow plug and time constant circuit means when the voltage across the capacitance means is above the predetermined value.

10. An apparatus as in claim 9, in which the comparator means is provided with hysterisis.

* * * * *